US009677419B2

(12) United States Patent
Heidingsfelder et al.

(10) Patent No.: US 9,677,419 B2
(45) Date of Patent: Jun. 13, 2017

(54) EXHAUST-GAS TURBOCHARGER

(75) Inventors: Leif Heidingsfelder, Ramstein (DE); Thomas Ramb, Worms (DE)

(73) Assignee: BorgWarner Inc., Auburn Hills, MI (US)

( * ) Notice: Subject to any disclaimer, the term of this patent is extended or adjusted under 35 U.S.C. 154(b) by 776 days.

(21) Appl. No.: 13/643,095

(22) PCT Filed: Apr. 21, 2011

(86) PCT No.: PCT/US2011/033397

§ 371 (c)(1),
(2), (4) Date: Oct. 24, 2012

(87) PCT Pub. No.: WO2011/139582

PCT Pub. Date: Nov. 10, 2011

(65) Prior Publication Data

US 2013/0039747 A1 Feb. 14, 2013

(30) Foreign Application Priority Data

Apr. 27, 2010 (DE) ..... 10 2010 018 430

(51) Int. Cl.

| | |
|---|---|
| ***F01D 25/16*** | (2006.01) |
| ***F01D 25/14*** | (2006.01) |
| ***F01D 25/26*** | (2006.01) |
| *F02B 39/00* | (2006.01) |

(52) U.S. Cl.

CPC ..... *F01D 25/16* (2013.01); *F01D 25/145* (2013.01); *F01D 25/26* (2013.01); *F02B 39/00* (2013.01); *F05D 2220/40* (2013.01); *F05D 2260/231* (2013.01)

(58) Field of Classification Search

CPC ..... F01D 25/08; F01D 25/24; F01D 25/243; F01D 25/145; F01D 25/16; F01D 25/26; F05D 2220/40; F05D 2260/231; F02C 6/12; F04D 29/5853; F04D 29/5893; F02B 39/00

See application file for complete search history.

(56) References Cited

U.S. PATENT DOCUMENTS

| | | | | |
|---|---|---|---|---|
| 6,231,944 | B1 * | 5/2001 | Holt | 428/57 |
| 6,428,293 | B1 * | 8/2002 | Dewar et al. | 418/55.1 |
| 7,174,719 | B2 * | 2/2007 | Kim | 60/805 |
| 7,272,929 | B2 * | 9/2007 | Leavesley | 60/602 |
| 7,509,804 | B2 | 3/2009 | Kobayashi | |
| 7,559,199 | B2 * | 7/2009 | Sausse et al. | 60/602 |

(Continued)

FOREIGN PATENT DOCUMENTS

| | | |
|---|---|---|
| JP | 2005-042588 A | 2/2005 |
| KR | 10-2006-0006442 A | 1/2006 |

(Continued)

*Primary Examiner* — Dwayne J White
*Assistant Examiner* — Adam W Brown
(74) *Attorney, Agent, or Firm* — Eric L. Doyle; Stephan A. Pendorf; Patent Central LLC

(57) ABSTRACT

An exhaust-gas turbocharger (1) having a bearing housing (9); a turbine housing (2) which is fastened to the bearing housing (9); and a heat shield (12) which has a heat insulating region (13) arranged between the turbine housing (2) and the bearing housing (9). The heat insulating region (13) is provided, in its outer circumferential region (14), with a seal (15).

12 Claims, 5 Drawing Sheets

(56) References Cited

U.S. PATENT DOCUMENTS

| | | | | |
|---|---|---|---|---|
| 7,802,429 | B2 | 9/2010 | Yokoyama et al. | |
| 2006/0037317 | A1 | 2/2006 | Leavesley | |
| 2007/0089414 | A1* | 4/2007 | Yokoyama | F01D 9/026 60/605.1 |
| 2008/0260520 | A1* | 10/2008 | Hettinger et al. | 415/163 |

FOREIGN PATENT DOCUMENTS

| | | | |
|---|---|---|---|
| KR | 10-2007-043599 | A | 4/2007 |
| KR | 10-2007-0079566 | A | 8/2007 |

* cited by examiner

EXHAUST-GAS TURBOCHARGER

BACKGROUND OF THE INVENTION

Field of the Invention

The invention relates to an exhaust gas turbocharger with a housing designed to prevent leakage of exhaust gas to the environment.

Description of the Related Art

Against the background of ever more stringent exhaust-gas standards (for example EURO 6), the generic exhaust-gas turbocharger has room for improvement insofar as leakage of exhaust gas into the environment can occur.

BRIEF SUMMARY OF THE INVENTION

It is therefore an object of the present invention to provide an exhaust-gas turbocharger of the type specified in the preamble of claim 1, by means of which it is possible to curtail or at least reduce the leakage gas rate.

Said object is achieved by means of the features of claim 1.

According to the invention, therefore, a heat shield of an exhaust-gas turbocharger is provided which, in addition to the main function of protecting the bearing arrangement from overheating, also performs a sealing function to prevent leakage of exhaust gas into the environment. For this purpose, that region of the heat shield which is compressed between the turbine housing and the bearing housing during the assembly of the exhaust-gas turbocharger is provided with a sealing function.

The subclaims relate to advantageous refinements of the invention.

According to the invention, there are different possible ways to connect a seal in the outer circumferential region to the heat insulating region of the heat shield. Firstly, the heat insulating region and the outer circumferential region may constitute an integral component, for which purpose the heat insulating region and the outer circumferential region may be produced from a single component, for example by means of an extrusion process.

It is alternatively possible for the outer circumferential region to be a separate component which can be connected to the heat insulating region of the heat shield. Possible types of connection are cohesive connections, in particular laser-welded connections, or positively locking connections.

In any case, a uniform component is formed in which the heat insulating region and the sealing region are fixedly connected to one another such that a single component, as explained above, can serve both to provide protection against overheating and also to perform a sealing function.

BRIEF DESCRIPTION OF THE SEVERAL VIEWS OF THE DRAWINGS

Further details, advantages and features of the present invention will emerge from the following description of exemplary embodiments on the basis of the drawing, in which.

DETAILED DESCRIPTION OF THE INVENTION

Figure 1:
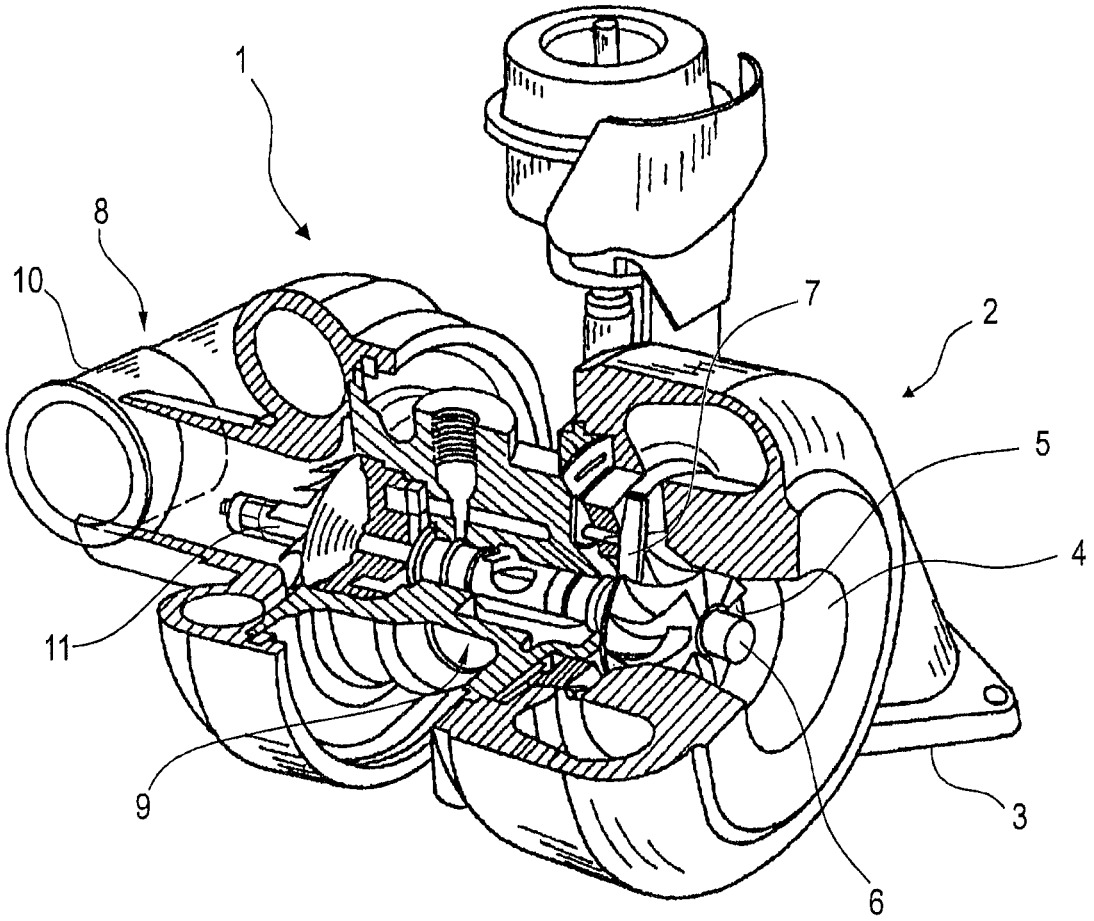
FIG. 1 shows a partially cut-away perspective illustration of a turbocharger according to the invention.

FIG. 1 illustrates by way of example a turbocharger 1 according to the invention in the form of a VTG exhaust-gas turbocharger which may be provided with the heat shield according to the invention.

The turbocharger 1 has a turbine housing 2 which comprises an exhaust-gas inlet opening 3 and an exhaust-gas outlet opening 4. Furthermore, a turbine wheel 5 is arranged in the turbine housing 2, which turbine wheel is fastened to a shaft 6.

A multiplicity of blades, of which only the VTG blade 7 is visible in FIG. 1, is arranged in the turbine housing 2 between an exhaust-gas inlet opening 3 and the turbine wheel 5. The exhaust-gas turbocharger 1 also has a compressor 8 with a compressor housing 10 in which is arranged a compressor wheel 11 which is seated on the shaft. The turbine housing 2 and the compressor housing 10 are connected to one another via a bearing housing 9.

The turbocharger 1 according to the invention self-evidently also has all the other conventional components of a turbocharger, such as for example the entire bearing unit of the bearing housing 9, but these will not be described below because they are not necessary for explaining the principles of the present invention.

Figure 3:
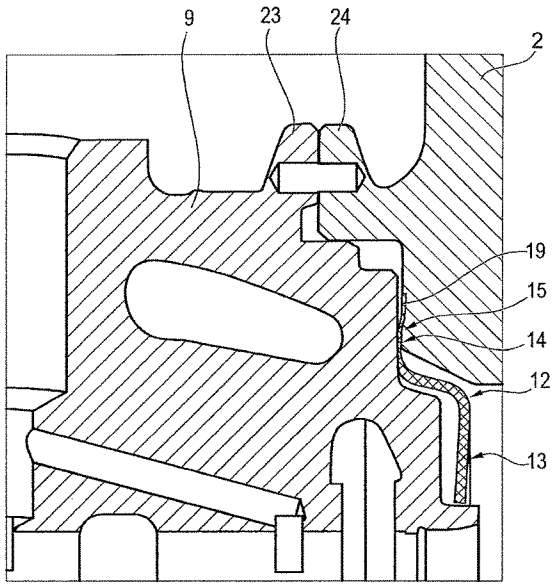
FIGS. 2 and 3 show sectional illustrations of a partial region of the bearing housing and turbine housing, with installed heat shield, of a first embodiment of the invention.
Figure 2:
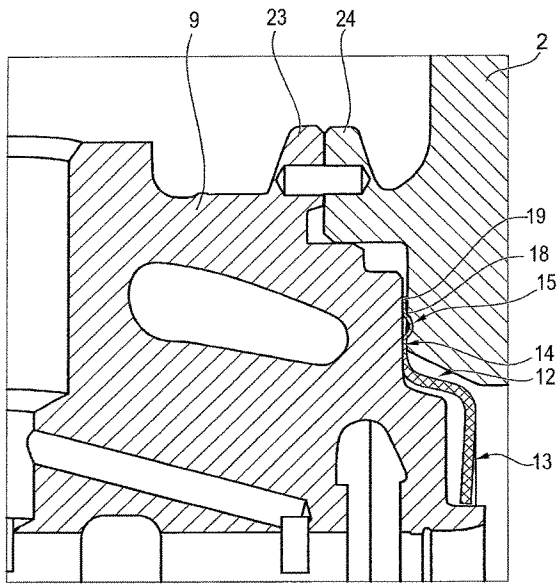

FIGS. 2 and 3 illustrate a first embodiment of the invention. As is clearly shown in FIGS. 2 and 3, a heat shield 12 is arranged between the turbine housing 2 and the bearing housing 9, which heat shield comprises a heat insulating region 13, on the outer circumferential region 14 of which is arranged a seal 15. The seal 15 has a sealing bead 18 which is arranged on a sealing strip 19. In the present exemplary embodiment, the seal 15 and the heat insulating region 13 form an integral component which, as explained in the introduction, can be produced by means of an extrusion process. In said extrusion process, the heat shield 12 including the seal 15 is produced from one component, with the sealing strip 19 and the sealing bead 18 preferably having a smaller material thickness than the heat insulating region 13.

As is clearly shown in FIG. 2, the turbine housing 2 and the bearing housing 9 delimit a gap, the axial width of which is smaller than the axial extent of the sealing bead 18. During the compression of the seal 15, as is shown in FIG. 3, the turbine housing 2 is clamped against the bearing housing 9 via flanges 23 and 24, and accordingly the seal 15 is compressed such that it can seal off the gap between the bearing housing 9 and the turbine housing 2 in a gas-tight fashion.

Figure 5:
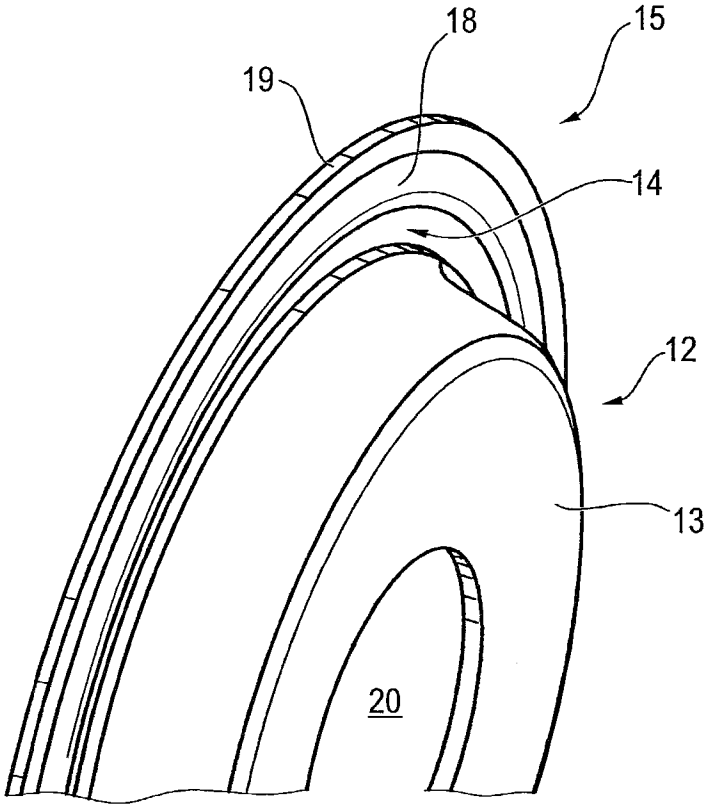
FIG. 5 shows a partially perspective illustration of the heat shield according to FIG. 4.
Figure 4:
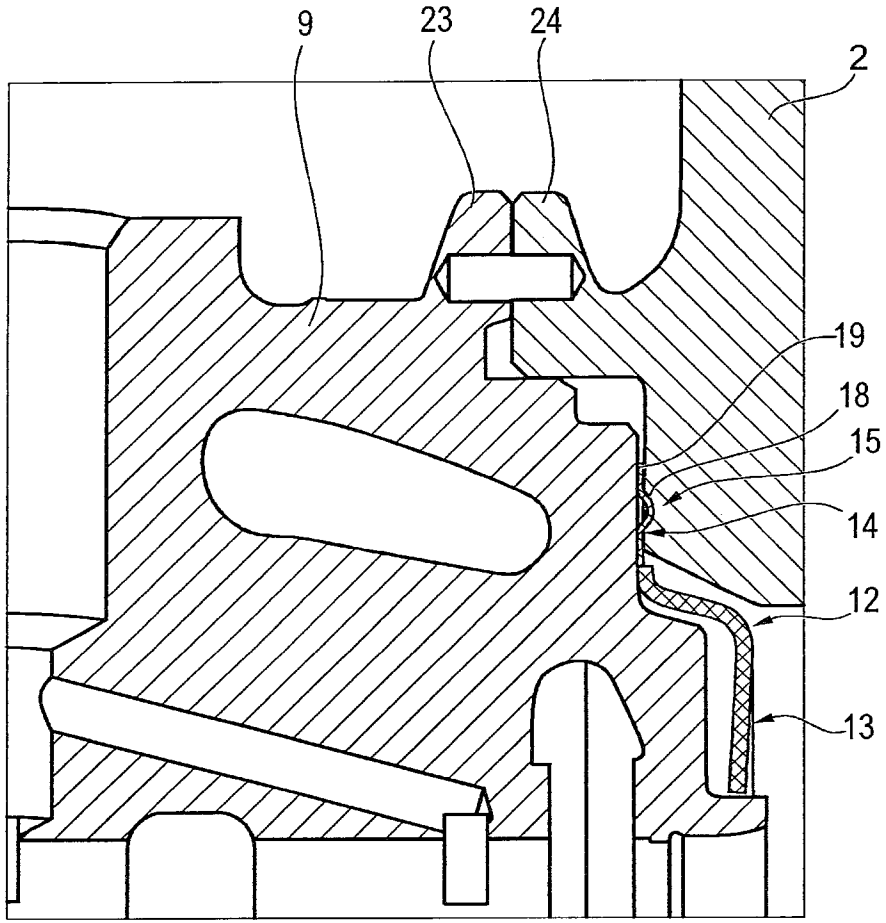
FIG. 4 shows an illustration, corresponding to FIG. 2, of a second embodiment of the heat shield according to the invention.

In the embodiment according to FIGS. 4 and 5, all the parts corresponding to those in FIGS. 2 and 3 are provided with the same reference numerals. With regard to said parts, reference may be made to the description above.

In the seal 15 illustrated in FIGS. 4 and 5, the heat insulating region 13 and the sealing strip 19 are connected to one another by means of a cohesive connection, such as in particular by means of a laser welding process. As is clearly shown in particular in FIG. 4, the material thickness of the sealing strip 19 and of the sealing bead 18 is in turn smaller than that of the heat insulating region 13, in order that no excessively high assembly forces need be imparted as the seal is compressed.

Figure 7:
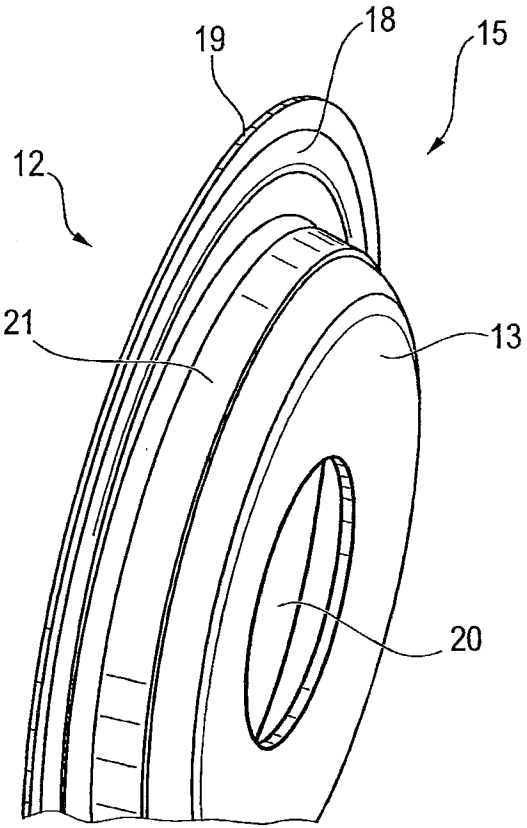
FIG. 7 shows an illustration, corresponding to FIG. 5, of the heat shield according to FIG. 6.
Figure 6:
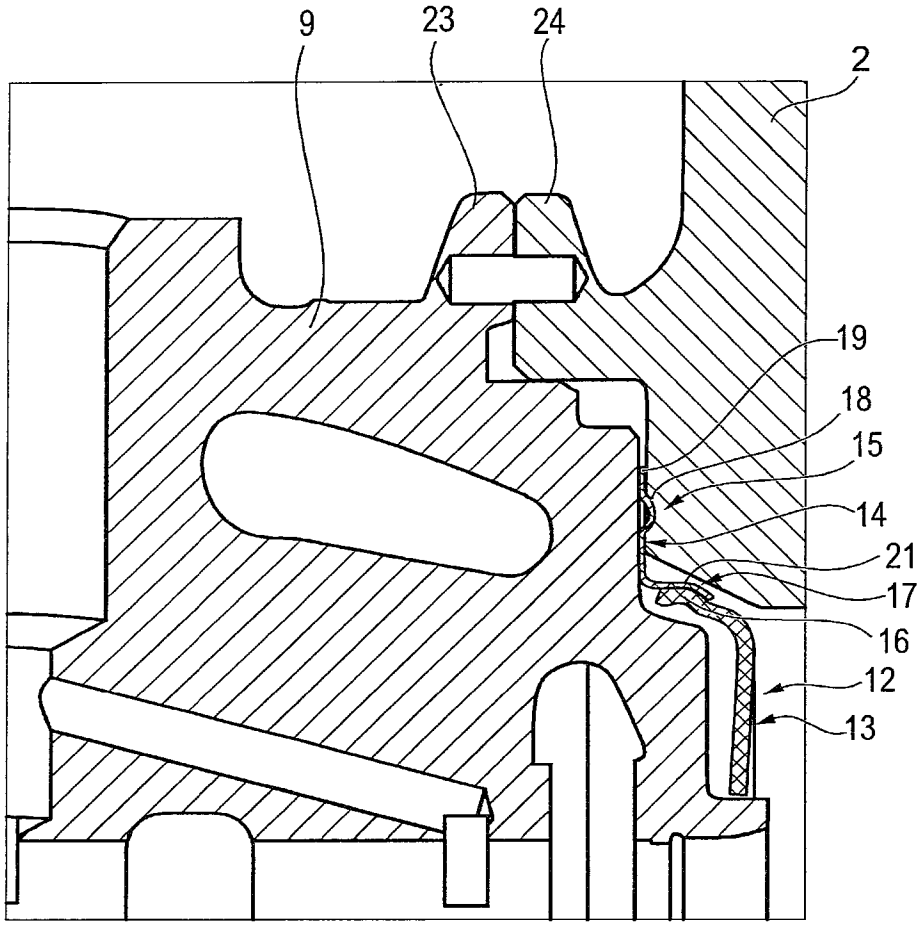
FIG. 6 shows an illustration, corresponding to FIG. 4, of a further embodiment of the heat shield according to the invention.

FIGS. 6 and 7 show a further possibility for connecting the heat insulating region 13 to the seal 15. In this case, a positively locking connection is provided which is realized by the formation of a bead 16 in the outer circumferential region 14 at a connecting point 17 between the heat insulating region 13 and the sealing strip 19. As is also evident from the illustration of FIGS. 6 and 7, this results in an attachment region 21 of the sealing strip 19 following the contour of the bead 16, wherein in this case, too, the material thickness of the seal 15 is smaller than that of the heat insulating region 13.

Figure 9:
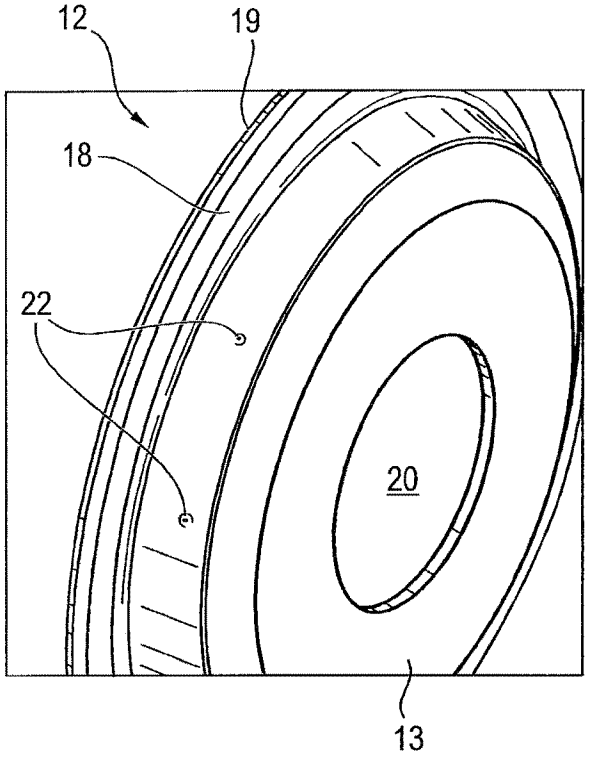
FIG. 9 shows a perspective illustration, corresponding to FIGS. 5 and 7, of the heat shield shown in FIG. 8.
Figure 8:
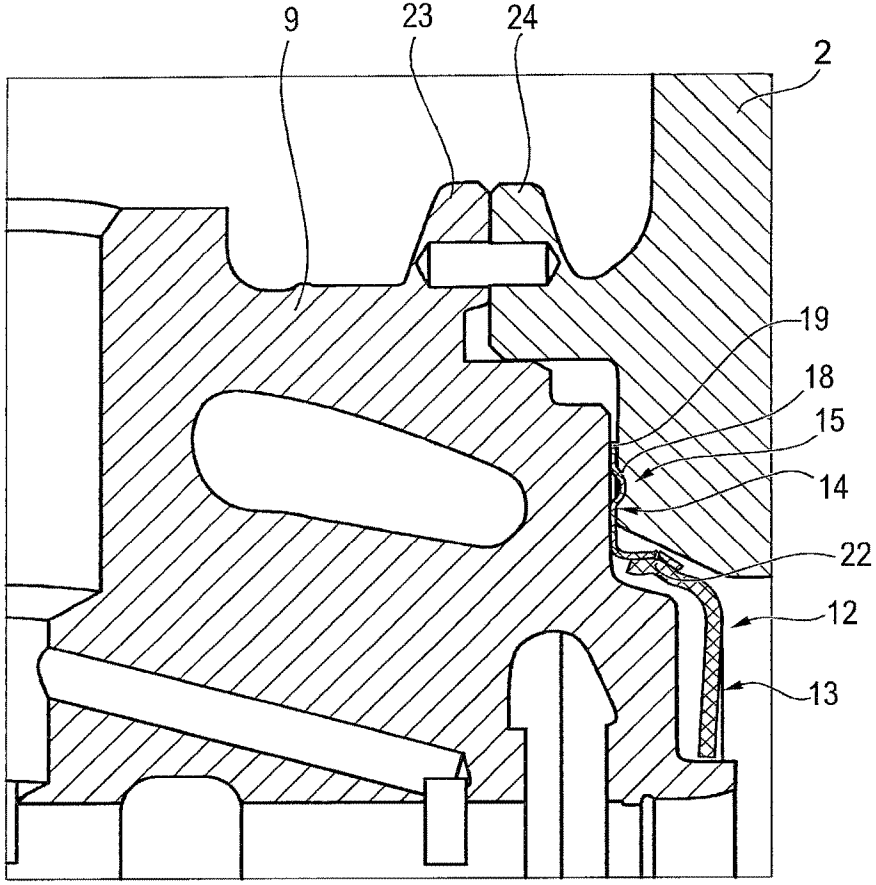
FIG. 8 shows an illustration, corresponding to FIGS. 4 and 6, of a further embodiment of the heat shield according to the invention.

FIGS. 8 and 9 represent a further possibility for a connection between the heat insulating region 13 and the seal 15, wherein in this case, a positively locking connection is produced by pinching the outer circumferential region 14 together with the sealing strip 19 at a plurality of points, one of which is indicated by the reference numeral 22 in FIGS. 8 and 9.

As is finally shown by a juxtaposition of FIGS. 5, 7 and 9, the heat insulating region 13 may be of pot-shaped or pot-like design, wherein its outer circumferential region 14 is adjoined in each case by the sealing strip 19 in the shape of a circular ring, and a through recess 20 for the shaft 6 of the exhaust-gas turbocharger 1 is provided centrally.

In addition to the above description, it is also pointed out that, by means of the extrusion process which was explained in conjunction with the embodiment according to FIG. 2, it is basically also possible for the material thickness, in particular sheet-metal thickness, of the heat shield to be varied at any desired location should this be possible or necessary. For example, it is possible in this way for gaps between the heat shield and the turbine wheel to be reduced and for material to be saved.

Aside from the written disclosure of the invention above, reference is hereby explicitly made to the graphic illustration thereof in FIGS. 1 to 9.

LIST OF REFERENCE NUMERALS

1 Exhaust-gas turbocharger
2 Turbine housing
3 Exhaust-gas inlet opening
4 Exhaust-gas outlet opening
5 Turbine wheel
6 Shaft
7 VTG blade
8 Compressor
9 Bearing housing
10 Compressor housing
11 Compressor wheel
12 Heat shield
13 Heat insulating region
14 Outer circumferential region
15 Seal
16 Bead
17 Connecting point
18 Sealing bead (half or full sealing bead)
19 Sealing strip
20 Through recess
21 Outer contour/attachment region
22 Connecting points
23, 24 Flanges

The invention claimed is:

1. An exhaust-gas turbocharger (1)
having a bearing housing (9);
having a turbine housing (2) which is fastened to the bearing housing (9); and
having a heat shield (12) which has a radially inner heat insulating region (13) and a radially outer circumferential region (14), the outer circumferential region (14) of the heat shield (12) being provided with a continuous circumscribing compression seal (15), wherein the outer circumferential region (14) is an integral constituent part of the heat shield, wherein the compression seal (15) is sandwiched between and in contact with the turbine housing (2) and the bearing housing (9), and with the compression seal (15) being clamped between the turbine housing (2) and the bearing housing (9) to form a seal between the bearing housing (9) and the turbine housing (2) in a gas-tight fashion.

2. The exhaust-gas turbocharger as claimed in claim 1, wherein the heat insulating region (13) and the seal (15) are formed from one component by an extrusion process.

3. The exhaust-gas turbocharger as claimed in claim 1, wherein the seal (15) is provided with a sealing bead (18).

4. The exhaust-gas turbocharger as claimed in claim 3, wherein the sealing bead (18) is arranged on a sealing strip (19) which is connected to the heat insulating region (13).

5. The exhaust-gas turbocharger as claimed in claim 1 wherein the material thickness of the seal (15) is smaller than the material thickness of the heat insulating region (13) of the heat shield (12).

6. The exhaust-gas turbocharger as claimed in claim 1, wherein the heat insulating region (13) is of pot-shaped design.

7. An exhaust-gas turbocharger (1)
having a bearing housing (9);
having a turbine housing (2) which is fastened to the bearing housing (9); and
having a heat shield (12) which has a radially inner heat insulating region (13) and a radially outer circumferential region (14), the outer circumferential region (14) of the heat shield (12) being provided with a continuous circumscribing compression seal (15) provided with a sealing bead (18), wherein the outer circumferential region (14) is a separate component which is connected to the heat insulating region (13) of the heat shield (12), the compression seal (15) being sandwiched between and in contact with the turbine housing (2) and the bearing housing (9), and the compression seal (15) being clamped between the turbine housing (2) and the bearing housing (9) to axially compress the sealing bead (18) to form a seal between the bearing housing (9) and the turbine housing (2) in a gas-tight fashion.

8. The exhaust-gas turbocharger as claimed in claim 7, wherein the seal (15) and the heat insulating region (13) are connected to one another by a cohesive connection.

9. The exhaust-gas turbocharger as claimed in claim 7, wherein the seal (15) and the heat insulating region (13) are connected to one another by means of a positively locking connecting device.

10. The exhaust-gas turbocharger as claimed in claim 9, wherein the heat insulating region (13) is provided with a bead (16) at a connecting point (17) to the seal (15).

11. The exhaust-gas turbocharger as claimed in claim 9, wherein the seal (15) and the heat insulating region (13) are connected to one another by pinching at a plurality of points (22).

12. The exhaust-gas turbocharger as claimed in claim 7, wherein the seal (15) and the heat insulating region (13) are connected to one another by a laser welding process.

* * * * *